US007077419B2

(12) United States Patent
Cuzzit et al.

(10) Patent No.: US 7,077,419 B2
(45) Date of Patent: Jul. 18, 2006

(54) SET OF BOARDS FOR GLIDING OVER SNOW AND MANUFACTURING PROCESS

(75) Inventors: Daniel Cuzzit, La Murette (FR); Henri-Charles Deborde, Bilieu (FR); Thierry Schrobiltgen, Attignat-Oncin (FR); Olivier Perrin, Passy (FR); Jean-Claude Deleglise, Thiez (FR)

(73) Assignee: Skis Rossignol S.A., Voiron (FR)

( * ) Notice: Subject to any disclaimer, the term of this patent is extended or adjusted under 35 U.S.C. 154(b) by 126 days.

(21) Appl. No.: 10/610,221

(22) Filed: Jun. 30, 2003

(65) Prior Publication Data

US 2004/0017062 A1 Jan. 29, 2004

(30) Foreign Application Priority Data

Jul. 23, 2002 (FR) ..... 02 09313

(51) Int. Cl.
*A63C 5/00* (2006.01)

(52) U.S. Cl. ..... 280/607; 280/609

(58) Field of Classification Search ..... 280/601, 280/607, 609, 611, 617, 618, 11.14
See application file for complete search history.

(56) References Cited

U.S. PATENT DOCUMENTS

| | | | | |
|---|---|---|---|---|
| 4,067,593 | A * | 1/1978 | Earl | 280/617 |
| 5,397,150 | A * | 3/1995 | Commier et al. | 280/607 |
| 5,474,321 | A * | 12/1995 | Pritz | 280/607 |
| 5,499,836 | A * | 3/1996 | Juhasz | 280/602 |
| 5,836,604 | A * | 11/1998 | Piegay | 280/607 |
| 5,871,223 | A * | 2/1999 | Zanco | 280/607 |
| 5,915,719 | A * | 6/1999 | Bauvois | 280/607 |
| 6,131,939 | A * | 10/2000 | Fels | 280/601 |
| 6,189,911 | B1 * | 2/2001 | Caron et al. | 280/607 |
| 6,217,055 | B1 * | 4/2001 | Silva | 280/607 |
| 6,241,272 | B1 * | 6/2001 | Hammerle | 280/609 |
| 6,257,612 | B1 * | 7/2001 | Zanco et al. | 280/607 |
| 6,315,317 | B1 * | 11/2001 | Liard et al. | 280/607 |
| 6,315,318 | B1 * | 11/2001 | Caron et al. | 280/617 |
| 6,325,404 | B1 * | 12/2001 | Liard et al. | 280/607 |
| 6,666,471 | B1 * | 12/2003 | Gatel | 280/602 |
| 6,783,145 | B1 * | 8/2004 | Deborde et al. | 280/607 |
| 2002/0113410 | A1 | 8/2002 | Deborde et al. | |
| 2003/0025299 | A1 | 2/2003 | Noviant | |

FOREIGN PATENT DOCUMENTS

| | | |
|---|---|---|
| DE | 298 20 426 | 1/1999 |
| EP | 0 956 886 A | 11/1999 |
| FR | 2 275 231 A | 1/1976 |
| FR | 2 634 659 A | 2/1990 |

* cited by examiner

*Primary Examiner*—Christopher P. Ellis
*Assistant Examiner*—Brian Swenson
(74) *Attorney, Agent, or Firm*—Burr & Brown

(57) ABSTRACT

A set of at least two boards for gliding over snow has dimensions, structures and/or upper faces of different geometries. Each board for gliding over snow is equipped with a platform for raising the binding elements. The platform is identical for all the boards for gliding over snow of the set. Each board for gliding over snow includes a special joint interposed between the platfonn and the upper face of the board for gliding over snow.

9 Claims, 2 Drawing Sheets

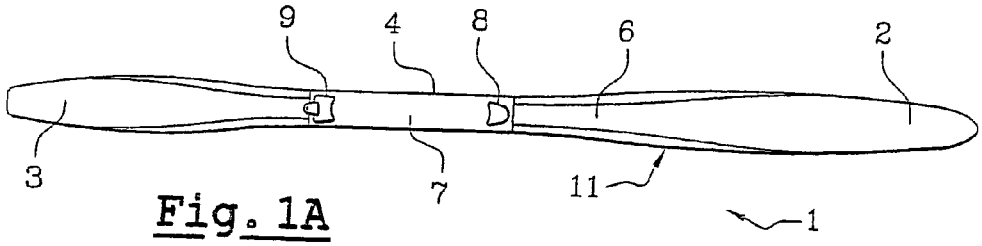
Fig. 1A
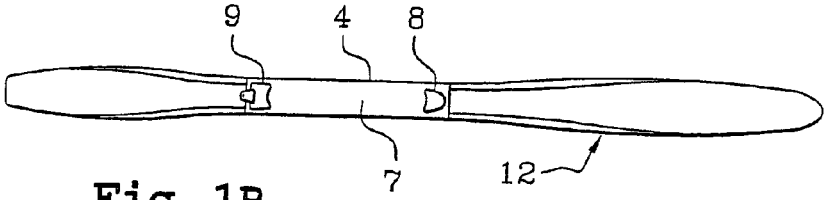
Fig. 1B
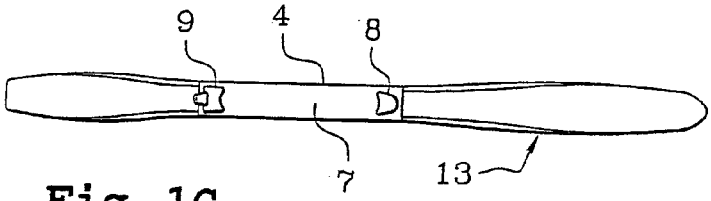
Fig. 1C
Fig. 2
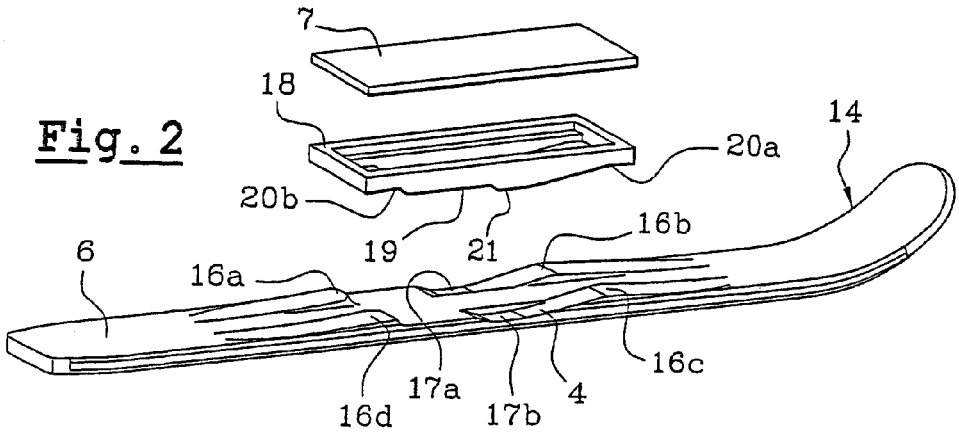

SET OF BOARDS FOR GLIDING OVER SNOW AND MANUFACTURING PROCESS

FIELD OF THE INVENTION

The present invention relates to a set of boards for gliding over snow. The present invention also relates to a process for manufacturing a set of boards for gliding over snow.

Background of the Invention

Boards for gliding over snow often comprise an accessory that is a platform for raising the heel and toe binding elements. This platform is mounted on the upper face of the board for gliding, in the region of the underfoot zone. Thus, all the platforms used have dimensions, shapes and materials that differ and are a function of the use, the geometry, and the dimensions of the board for gliding. These platforms are made from molded polymer materials or from lightweight, molded or machined, aluminum alloys. They are generally of varied types depending on the characteristics of the board for gliding.

Thus, in the case of a board for gliding, specifically dedicated to a particular style of skiing, for example slalom, giant slalom or Freeride, use will be made of a special platform. In the case of a board for gliding having a specific geometrical structure, for example a structure of the "shell" or "rectangular" type, use will also be made of another special platform. Furthermore, in the case of a board for gliding having a specific length, for example 1.70 m or 1.90 m, use will be made of another special platform. Lastly, certain boards have on their upper face recesses or other protruding zones. The type of platform used depends on the shape and the dimensions of these recesses and protrusions.

In the case of many boards for gliding comprising platforms, a joint is installed between the platform and the upper face of the board for gliding. This joint is made from a polymer material and has properties for damping the vibrations generated by the board for gliding and transmitted to the user's boot via the binding elements. The material of this joint may also have properties of elasticity and of providing greater dynamism when the user is seeking a rebound effect from the board by bearing firmly on the platform. This joint also allows a match to be made between the geometry of the platform and the shape of the board for gliding in the underfoot zone.

However, this multiplicity of existing platforms requires a manufacturer to have a large number of different molds, since each platform is designed for a specific board for gliding. In point of fact, molds are a particularly large investment owing to their production on a case-by-case basis and to their size. This investment pays off only as a function of the number of platforms made from a mold. Thus, the profitability of such a mold is far from assured.

This multiplicity of platforms requires management of stocks of platforms and of corresponding joints, which is highly complex. Moreover, this multiplicity of platforms may lead retailers to commit errors when fitting unsuitable platforms on boards for gliding.

SUMMARY OF THE INVENTION

A first problem that the invention proposes to solve is that of obtaining a set of boards for gliding over snow having unique structure-accessories that can be mounted on each of them. A second problem to be solved is that of simplifying the management of platform stocks relative to all existing boards for gliding, both for the manufacturer and for retailers, and thus that of avoiding fitting errors. A third problem to be solved consists in developing a process for manufacturing a set of boards for gliding over snow that is particularly cost-effective and requires less investment in terms of molding.

In accordance with a first aspect of the invention, a set of at least two boards for gliding over snow, having dimensions, structures and/or upper faces of different geometries, each board for gliding over snow being equipped with a platform for raising the binding elements wherein

- the platform is identical for all boards for gliding over snow of the set;
- each board for gliding over snow includes a special joint interposed between the platform and the upper face of the board for gliding over snow.

"Set of boards for gliding" is understood to mean boards for gliding of different ranges, models or dimensions. In other words, with just a single type of platform, all existing boards for gliding can be fitted out. Thus, only the joints vary in terms of shape and dimensions, as a function of the shapes and dimensions of the underfoot zones of the boards for gliding and of the shape and dimension of the lower face of the unique platform used.

The set may favorably comprise at least one board for gliding over snow of which the identical platform is fixed directly to the upper face of the board or boards for gliding over snow. Thus, these different ranges, models and dimensions may be supplemented with boards for gliding that do not have a joint.

In accordance with a second aspect of the invention, a process for manufacturing a set of boards for gliding over snow, is noteworthy in that it comprises the stages that consist of:

- producing the set of boards for gliding over snow with a plurality of boards for gliding over snow having different structures, geometries, and dimensions;
- mounting a joint on each of the boards for gliding over snow in the region of their respective underfoot zone, the joint having, toward its lower face, a shape and dimensions that are complementary so as to match said underfoot zone of each of the boards for gliding; and
- fixing, on the joint thus mounted, a platform for raising the binding elements securing a user's boot to the board for gliding over snow, said platform being of a single type that is strictly identical for the set of boards for gliding over snow, said joint having, toward its upper face, a shape and dimensions that are complementary such that the platform of a single type matches it.

The lower face of the platform of a single type may be substantially planar. By way of illustrative embodiment, the platform of a single type may advantageously be a platform in two longitudinal parts.

The set of boards for gliding over snow is characterized in that it is obtained by the implementation of the process as described above.

BRIEF DESCRIPTION OF THE FIGURES

The invention will be properly understood and its diverse advantages and different characteristics will become more apparent from the following description of the non-limiting illustrative embodiment, with reference to the appended diagrammatic drawings, in which:

FIG. 1A to 1C show a set of skis of three different sizes, each having a platform;

FIG. 2 shows an exploded view of a platform and of a joint ready to be fitted onto a ski with a special geometry in the underfoot zone;

DETAILED DESCRIPTION OF THE INVENTION

Figure 3:
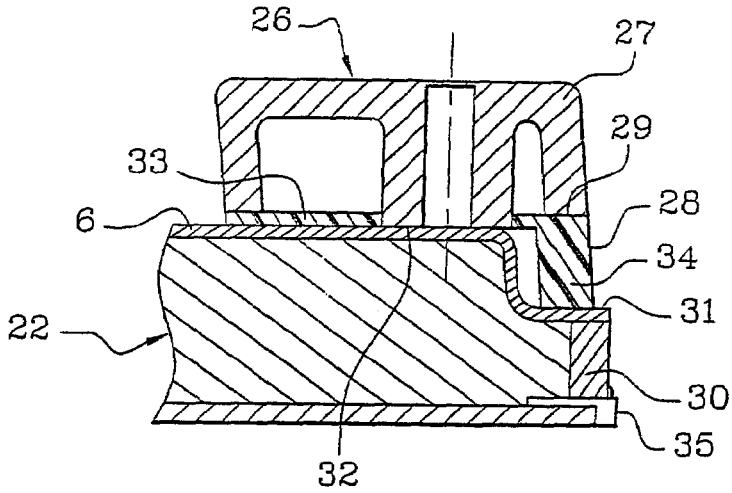
FIG. 3 shows a partial view in cross section of a ski having a first geometry and equipped with a platform.

As illustrated in FIG. 1, a board for gliding over snow, such as an alpine ski, comprises a tip (2), a heel zone (3), and a central, underfoot zone (4). A platform (7) is mounted in the region of the underfoot zone (4) and on the upper face (6) of the ski (1). This platform (7) is for raising the binding elements—the toe (8) and heelpiece (9)—securing a user's boot to the ski (1).

According to the invention, a single and unique platform (7) is fitted for a single ski constituting a set 1 and having three different sizes (see FIGS. 1A, 1B and 1C), for example 1.90 m (11), 1.80 m (12), and 1.70 m (13).

As shown in FIG. 2, for a model of skis (14), the underfoot zone (4) may have a special geometry. This geometry was described, for example, in document FR-2, 820,983 in the name of the applicant. The underfoot zone (4) comprises four ends with lateral, front and rear ridges (16*a*, 16*b*, 16*c* and 16*d*) that project from the upper surface 6 of the ski (14). The underfoot zone (4) also comprises two lateral hollows (17*a* and 17*b*) under the upper face (6) of the ski (14).

A specific joint (18) has been provided for fitting the single, unique platform (7) on this model of skis (14).

This joint (18) comprises, in the region of its lower face (19), four hollows (20*a* and 20*b*) that complement the four ends with ridges (16*a*, 16*b*, 16*c* and 16*d*). This joint (18) comprises, in the region of its lower face (19), two protrusions (21) that complement the two lateral hollows (17*a* and 17*b*).

Figure 4:
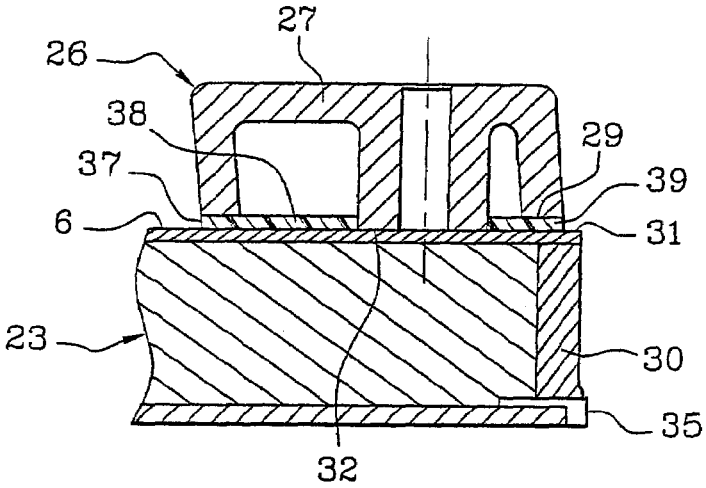
FIG. 4 shows a partial view in cross section of a ski having a second geometry and equipped with a platform.
Figure 5:
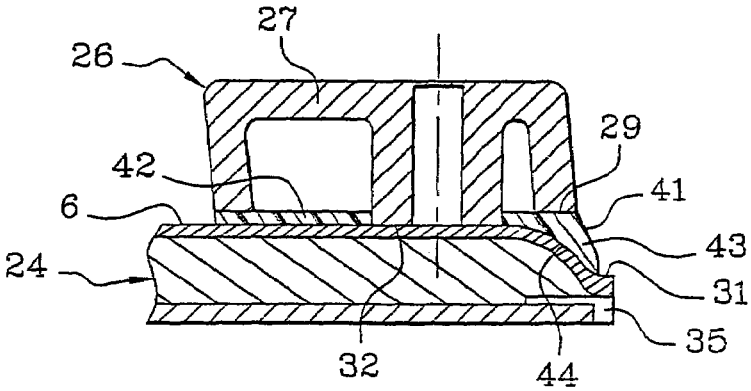
FIG. 5 shows a partial view in cross section of a ski having a third geometry and equipped with a platform.

A ski (22) such as that shown in FIG. 3 is a so-called shaped ski, also known by the Dualtec® brand name. It includes longitudinal strengthening elements forming sidewalls (30) present over only a portion of the height of the ski (22). A ski (23) such as that shown in FIG. 4 is a rectangular ski, also known as a ski with sidewalls. A ski (24) such as that shown in FIG. 5 is a so-called shell-construction ski, also known as a cap-construction ski.

A single, unique platform (26) is fitted on these three models of skis (22, 23 and 24), which constitute a set of skis. This platform (26) is in two longitudinal parts (27) (just one of the two longitudinal parts is shown in FIGS. 3 to 5). The platform (26) in two longitudinal parts (27) is, for example, described in document FR 2 827 184 in the name of the applicant.

With reference to FIG. 3, a joint (28) is placed between the lower face (29) of the longitudinal part (27) of the platform (26) and the upper face (31) of the underfoot zone (4) of the Dualtec® ski (22), in line with the longitudinal strengthening element part (30). This joint (28), providing the link between the upper face (6) of the ski (22) and the substantially planar lower face (32) of the platform (26), comprises a flat first element (33) and a second element (34) deployed toward the edge (35) and bearing on the surface (31) above the sidewalls (30) of the ski (22).

With reference to FIG. 4, a joint (37) is placed between the lower face (29) of the longitudinal part (27) of the platform (26) and the upper face (31) of the underfoot zone (4) of the sidewall ski (23), in line with the longitudinal strenthening element part (30). This joint (37), providing the link between the upper face (6) of the ski (23) and the substantially planar lower face (32) of the platform (26), comprises a flat first element (38) bearing on the upper face (6) in the region of the underfoot zone (4) and a second element (39) deployed toward the edge (35) and bearing on the surface (31) above the sidewalls (30) of the ski (23).

With reference to FIG. 5, a joint (41) is placed between the lower face (29) of the longitudinal part (27) of the platform (26) and the upper face (31) of the underfoot zone (4) of the shell-construction ski (24), in line with the edge (35). This joint (41), providing the link between the upper face (6) of the ski (24) and the substantially planar lower face (32) of the platform (26), comprises a flat first element (42) and a second element (43) deployed toward the edge (35) and bearing on the sidewalls (44) of the shell of the ski (24).

By virtue of the present invention, a complete range of skis can be fitted with a single, unique platform that may be in the form of a single piece or as two longitudinal parts. The joints remain specific to each of the skis.

The present invention is not limited to the embodiments described and illustrated. A number of modifications may be made without thereby departing from the framework defined by the scope of the set of claims.

The invention claimed is:

1. A set of at least two pairs of boards for gliding over snow, two boards constituting a pair of boards of said set being identical to each other, two identical boards of one pair of said set having dimensions, structures and/or upper faces in underfoot zones thereof that differ from two identical boards of another pair of said set, each board comprising:

i) a platform for raising binding elements, the platform being identical for the set of at least two pairs of boards; and ii) a special joint configured to complement the dimensions, structures and/or upper faces in the underfoot zone of each board, interposed between the platform and the upper face of the board.

2. The set as claimed in claim 1, which further comprises a second set of at least one board for gliding over snow, the identical platform being fixed directly to the upper face of the at least one board of the second set.

3. A process for manufacturing a set of at least two pairs of boards for gliding over snow, comprising:

i) producing the set such that two boards constituting a pair of boards of said set are identical to each other and two identical boards of one pair of said set have structures, geometries, and/or dimensions in underfoot zones thereof that differ from two identical boards of another pair of said set;

ii) mounting a joint on each of the boards in the region of their respective underfoot zone, the joint having, toward its lower face, a shape and dimensions that are complementary so as to match said underfoot zone of each of the boards; and iii) fixing, on the joint thus mounted, a platform for raising binding elements for securing a user's boot to the board, said platform being of a single type that is identical for the set of boards, said joint having, toward its upper face, a shape and dimensions that are complementary to match the platform.

4. The process as claimed in claim 3, wherein the lower face of the identical platform is substantially planar.

5. The process as claimed in claim 3, wherein the platform includes two longitudinal pans.

6. A set of boards for gliding over snow, which is obtained by implementing the process as claimed in claim 3.

7. The process as claimed in claim 4, wherein the platform includes two longitudinal parts.

8. A set of boards for gliding over snow, which is obtained by implementing the process as claimed in claim 4.

9. A set of boards for gliding over snow, which is obtained by implementing the process as claimed in claim 5.

* * * * *